US005731537A

United States Patent [19]

Sassaman

[11] Patent Number: 5,731,537

[45] Date of Patent: Mar. 24, 1998

[54] SYSTEM AND METHOD FOR REFORMING SHOTSHELLS

[76] Inventor: Glenn Eldridge Sassaman, 6234 Charlesgate Rd., Huber Heights, Ohio 45424

[21] Appl. No.: 647,350

[22] Filed: May 9, 1996

[51] Int. Cl.[6] ..... F42B 33/10

[52] U.S. Cl. ..... 86/24; 86/23; 86/25; 86/1.1; 29/1.3; 264/296

[58] Field of Search ..... 86/1.1, 10, 23–41; 102/466, 467; 29/1.3, 1.31, 1.32; 264/296

[56] References Cited

U.S. PATENT DOCUMENTS

| | | | |
|---|---|---|---|
| 3,196,736 | 7/1965 | Pace | 86/25 |
| 3,552,259 | 1/1971 | Griffith | 86/20.1 |
| 3,598,014 | 8/1971 | Vadas | 86/28 |
| 3,702,089 | 11/1972 | Bachhuber | 86/32 |
| 3,771,411 | 11/1973 | Hazel | 86/27 |
| 3,784,057 | 1/1974 | Tuttle | 221/196 |
| 3,796,127 | 3/1974 | Deitemeyer | 86/30 |
| 3,897,729 | 8/1975 | Schirneker | 102/38 |
| 3,919,921 | 11/1975 | Schirneker | 89/132 |
| 3,944,444 | 3/1976 | Thiess et al. | 148/12.4 |
| 3,973,465 | 8/1976 | Bachhuber et al. | 86/23 |
| 4,078,472 | 3/1978 | Simpson | 86/23 |
| 4,176,583 | 12/1979 | Lage | 86/24 |
| 4,227,330 | 10/1980 | Chapin | 42/77 |
| 4,232,468 | 11/1980 | Chapin | 42/77 |
| 4,290,365 | 9/1981 | Dreyer | 102/449 |
| 4,292,877 | 10/1981 | Lee | 86/31 |
| 4,311,409 | 1/1982 | Stang | 405/52 |
| 4,329,906 | 5/1982 | Heers | 86/36 |
| 4,331,063 | 5/1982 | Schaenzer | 86/36 |
| 4,445,693 | 5/1984 | Angwin | 273/404 |
| 4,502,363 | 3/1985 | Zimmerman | 86/24 |
| 4,571,983 | 2/1986 | Sanborn et al. | 72/462 |
| 5,171,934 | 12/1992 | Moore | 102/449 |
| 5,177,315 | 1/1993 | Burgess | 86/27 |
| 5,277,852 | 1/1994 | Spydevold | 264/51 |

OTHER PUBLICATIONS

"REX–C100 Series Instruction Manual," by RKC Instrument, Inc. of Tokyo, Japan, 10 pgs, dated Feb., 1993.

"idec RSS Series: Solid State Relays," pp. D3–1 and D3–2 (undated).

"Cartridge Heaters: Firerod Cartridge," St. Louis, Missouri, pp. 79–80 and 107 (undated).

*Primary Examiner*—Harold J. Tudor

*Attorney, Agent, or Firm*—Jacox, Meckstroth & Jenkins

[57] ABSTRACT

A shell reforming system and method is shown comprising an automatically temperature-controlled and detachable heat mandrel on which a shell may be situated for a predetermined period of time. The system and method further utilize a plurality of detachable cooling mandrels which facilitate cooling the shell and deforming it to a desired shape, such as a generally elongated cylinder shape. The system and method is suitable for handling multiple gauge shells and for maintaining and controlling the temperature delivered to the heat mandrel so that shotshells may be reformed consistently. A method for reconditioning and reshaping the shotshells using the automatically controlled heat source is also disclosed.

39 Claims, 3 Drawing Sheets

SYSTEM AND METHOD FOR REFORMING SHOTSHELLS

BACKGROUND OF THE INVENTION

1. Field of the Invention

This invention relates to a system and method for reconditioning expended shotshells and, more particularly, to a system and method for automatically controlling the temperature of a heat mandrel used to shape the expended shotshell to a desired shape.

2. Description of the Related Art

In the past, there have been numerous types of shotshell reloading devices for reloading shotshells after they have been expended. In general, the shotshells include a thermoplastic tubular portion having a base portion and an open-mouth portion at its opposite end. Typically, the tubular portion is very stiff and rigid and, once fired, axially extending crimps or creases in the forms of ridges develop at the open-mouth portion. Before reloading is possible or in order to expedite the reloading procedure or to put the shells into a form which permits them to be reloaded easily, it is often necessary to remove the ridges.

Conventional reloading devices are not able to conveniently remove the ridges, and thus the spent shells are not readily reloaded with powder and shot.

It is not uncommon that common-day reloading machines and devices shown therein include presses or other devices for forcefully pushing a member axially down into the deformed shell for swedging or otherwise forcefully pushing the ridges back out to its nearly original circular configuration. Thus, heretofore reloading machines have not completely eliminated the ridges and the spent shotshell so that the subsequent reloading process is very difficult and sometimes awkward.

Additionally, for some applications, ballistic pattern drivers, in the form of tubular plastic inserts, are slipped into the shotshell. However, should the crimps or creases not be completely, or at least substantially completely removed prior to the insertion of the drive, it is difficult to insert the driver down into the tubular shotshell until it comes to rest on the powder at the bottom thereof.

If the shell is out of round, due to the presence of the ridges, which were not completely removed, the ballistic pattern driver can be damaged if it is not carefully inserted into the shell. The damage to the driver almost always occurs to the seal and thus adversely affects the flight pattern of the ballistic pattern driver. Thus, undesirable flight patterns of the shot coming out of the shotshell result.

In U.S. Pat. No. 4,502,263 issued to Zimmerman on Mar. 5, 1985, a tool for reconditioning the crimped shotshell to make it circular is shown having an elongated cylindrical body. The outer surface of a tip of the body is adapted to be heated with a blow torch to a high temperature in the range of 250° F. to 350° F. The heated tip is manually inserted into contact with the crimped mouth portion of the expended shotshell body to melt and thus to reshape it. Unfortunately, the blow torch may tend to cause the outer surface of a forwardly-disposed blunt distal end portion to be become porous or rough such that inserting it in and out of the shotshell becomes more difficult.

Further, because the outer surface of the tip portion of the tool is heated with a blow torch, the temperature is not controlled, thus making it somewhat difficult to consistently reshape multiple shotshells. For example, after one or more shells have been reshaped, the tip portion tends to cool, thereby requiring more time to reshape subsequent shotshells.

Another problem with such a device deals with safety. Because external sources, such as blow torches, were needed to heat the tip, the increase of risk of injury to the user by handling either the blow torch or the hand tool was increased.

Also, the type of this device only comprises one gauge and does not appear to be interchangeable. Thus, this type of device appears to only function well with a single gauge, not multiple gauges.

What is needed, therefore, is a temperature controlled and programmable shell-reforming system and method which can operate to consistently reform multiple shotshells without the need for external heat sources such as blow torches and the like.

SUMMARY OF THE INVENTION

It is therefore a primary object of the invention to provide a new and improved system and method for reconditioning and reshaping spent shotshells.

Another object of the present invention is to provide a system and method which comprises a heat mandrel having an automatically controlled heat source for heating the mandrel.

Another object of the present invention is to provide a shell-forming system and method which comprises a heater which is integral to the mandrel used to recondition the shotshell, thereby facilitating the reduction of injury to a user of the system and method.

Still another object of the present invention is to provide a system and method which can accommodate shotshells of multiple gauges.

Yet another object of the present invention is to provide a system and method for reshaping shells having controllable temperatures which can operate at controlled temperatures of less than 250° F.

In one aspect this invention comprises a shell reforming system consisting of a mandrel for receiving a shell and a heater associated with said mandrel for heating said mandrel to a preselected temperature, the heater comprising a controller for controlling the heat delivered to the mandrel, such that when the shell is situated over the mandrel, the shell becomes deformed to a desired shape.

In another aspect this invention comprises a method for forming a shell consisting of the steps of heating the heat mandrel to a controlled temperature, situating the shell on the heat mandrel to reform the heat mandrel and removing the shell.

In yet another aspect this invention comprises a shotshell forming device consisting of a base, a heat mandrel secured to the base, a heater coupled to the heat mandrel for heating the heat mandrel to a desired temperature, a controller situated on the base and coupled to the heater for controlling heat delivered by the heater to the heat mandrel.

In still another aspect this invention comprises a method for reforming a used shotshell consisting of the steps of heating a heat mandrel to a controlled temperature of less than 300 degrees Fahrenheit, situating the used shotshell on the heat mandrel for a predetermined period of time and removing the used shotshell.

These and other objects and advantages of the invention will be apparent from the following description, the accompanying drawings and the appended claims.

BRIEF DESCRIPTION OF ACCOMPANYING DRAWING

DETAILED DESCRIPTION OF PREFERRED EMBODIMENT

Figure 1:
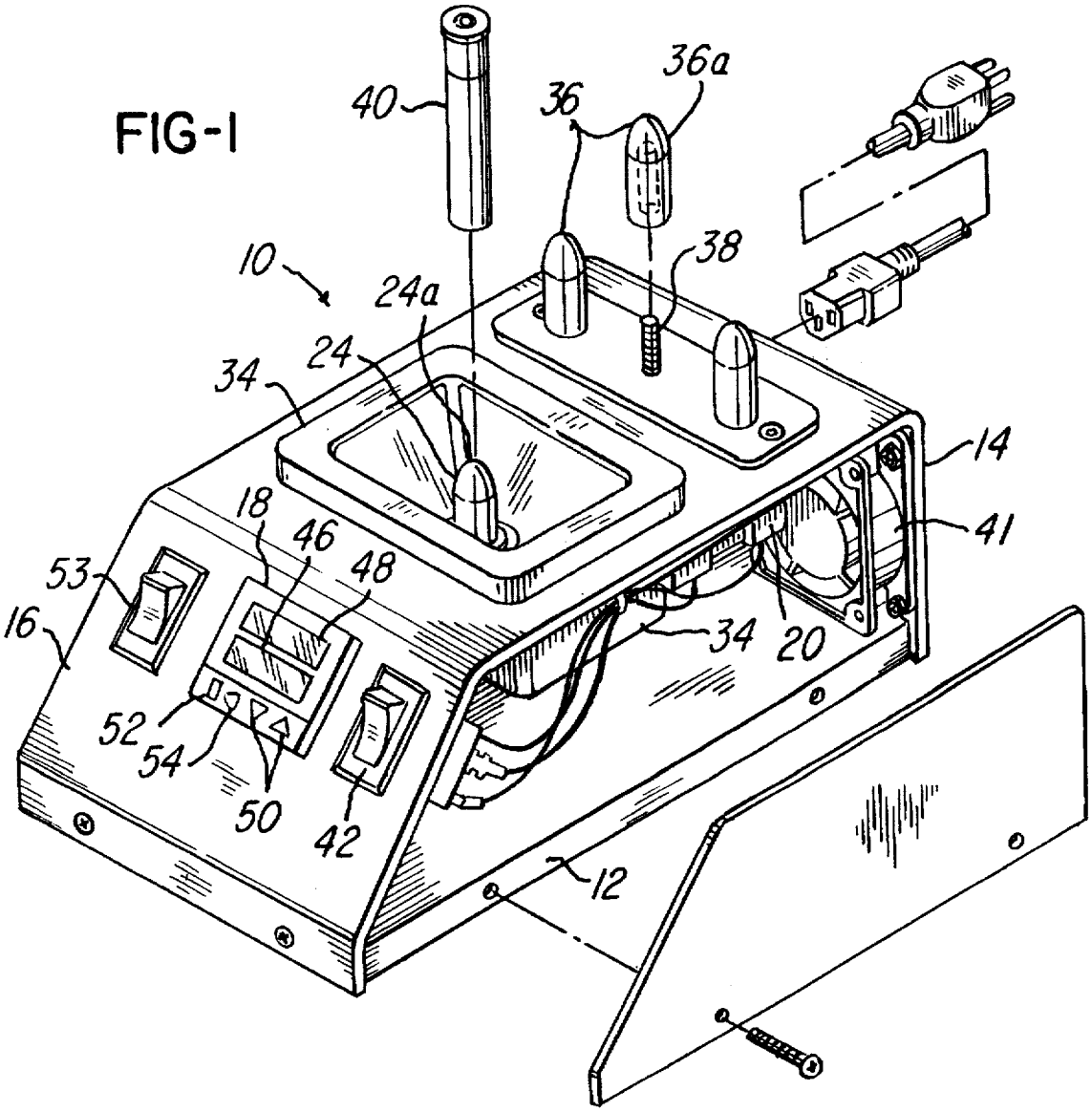
FIG. 1 is a general perspective view of a system according to the present invention showing a detachably mounted heat mandrel, as well as plurality of cooling mandrels and a programmable controller for controlling the temperature of the heat mandrel.

Referring now to FIG. 1, a shell reforming system 10 is shown comprising a base 12 having a housing 14 which is preferably constructed of a thermoplastic or plastic material in the embodiment being described.

As illustrated in FIG. 1, the housing 14 comprises a front face or panel 16 on which a plurality of instrument switches are mounted. In this regard, notice that the shell reforming system 10 comprises a controller 18 for controlling the operation of the shell reforming system. In the embodiment being described, one suitable controller is the model REX-C100 series controller available from R.K.C. Instrument, Inc. of Tokyo, Japan.

Figure 2:
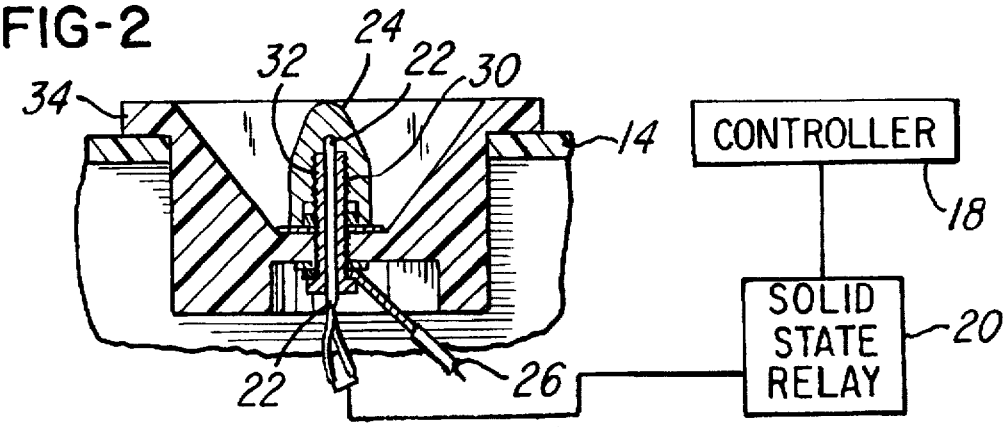
FIG. 2 is a fragmentary sectional view showing various details of the system shown in FIG. 1.

The controller 18 is coupled to a solid state relay 20 (FIG. 2). One suitable solid state relay 20 is the RSS series relay manufactured by Idec Corporation of Sunnyvale, Calif. The relay 20 is, in turn, coupled to a heat cartridge 22 (FIG. 2) which is situated internally in a heat mandrel 24. Notice also that the shell reforming system 10 further comprises a thermocouple 26 which couples the heat cartridge 22 to the controller 18 as shown. In the embodiment being described, the thermocouple 26 is a type "J", iron constantan thermocouple rated to 900° F.

In the embodiment being described, the heat cartridge 22 is approximately ⅛ inch diameter by 1¼ inches and is inserted directly into an aperture 30 in heat mandrel 24. In the embodiment being described, the heat cartridge 22 may be inserted into a sleeve 32 having a plurality of threads which are threadably received in the aperture 30 of heat mandrel 24 as shown in FIG. 2 in order to secure the heat cartridge 22 to the heat mandrel 24. In the embodiment being described, one suitable heat cartridge is the FIR-EROD® cartridge available from Watlow, St. Louis, Mo.

It should be appreciated that the controller 18 has a temperature maximum of 2192° F. and is capable of controlling the temperature of the heat cartridge 22 such that it can heat the heat mandrel 24 to temperatures between 0° and 900° F. (which is the maximum range of the thermocouple 26). Despite this wide temperature range, it has been found that it is preferable to operate the shell reforming system 10 at ranges between 200°–300° . The controller 18 may be selectively programmed to various maximum temperatures, such as 300° F. Also, the controller can be selectively set or locked to any desired maximum temperature before or during operation.

As best illustrated in FIG. 2, the housing 14 may comprise a recessed area 32 which is defined by a heat mandrel support 34 which supports the heat mandrel 24 in a generally upright position as illustrated in FIG. 1. In this embodiment, the heat mandrel support 34 is comprised of a Teflon tray which is capable of withstanding temperatures of up to about 550°–600° F.

Figure 4:
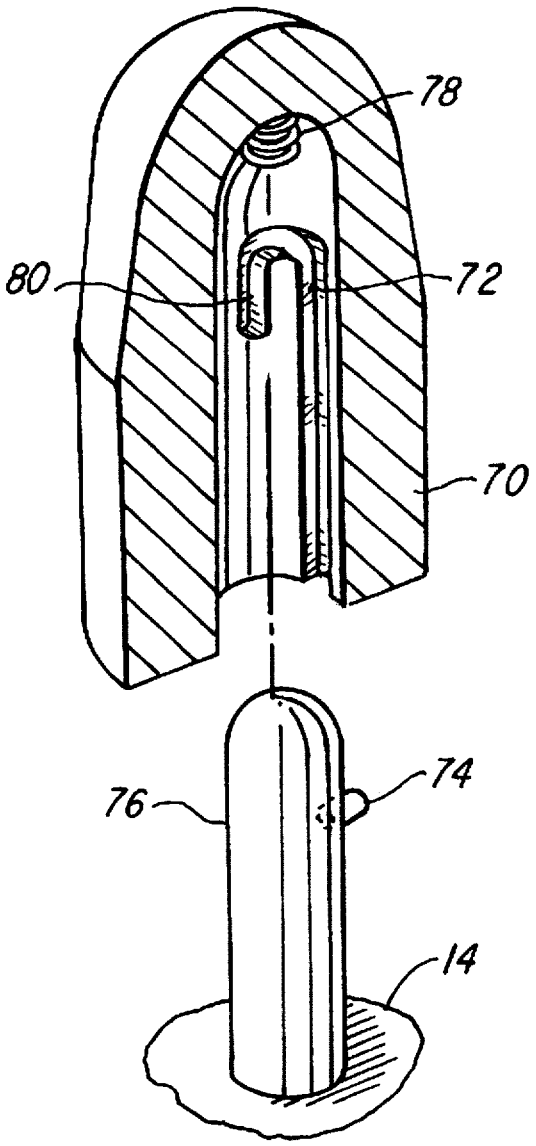
FIG. 4 is a fragmentary view of a locking device for locking a mandrel to a base.

Notice in FIG. 1 that the housing 14 also comprises a plurality of interchangeable cooling mandrels 36 each having an internal thread and being detachably and threadably mounted on receiving screws, such as screw 38. It should be appreciated that the heat mandrel 24 and cooling mandrels 36 may also comprise other means, for detachably securing or locking the heat mandrel 24 to the heat mandrel support 34 and cooling mandrels 36 to housing 14. For example, FIG. 4 illustrates another embodiment locking means, showing a mandrel 70 having a slot 72 for receiving a locking lug 74. The mandrel 70 is initially situated over lug 74 and post 76. Therefore, the mandrel 70 is turned counterclockwise (as viewed in FIG. 4) until a spring 78 coupled to mandrel 70 causes locking lug 74 to be biased in locking area 80, thereby detachably locking the mandrel 70 to the housing 14.

As best illustrated in FIG. 1, the cooling mandrels 36 and heat mandrel 24 are approximately 1¼" high and are made of metal and comprise a parabolic-shaped tip as shown. This shape facilitates receiving a shotshell 40 for reforming. Notice also that an outer surface **36*a* of each cooling mandrel 36 and outer surface 24*a* of heat mandrel 24 are chrome plated in the embodiment being described in order to decrease friction between the shotshell 40 and the mandrels 24 and 36 when shotshell 40** is situated thereon. It should be appreciated that various other types of plating, such as Enlube® available from Enthone-OMI, Inc. of New Haven, Conn., may be used as well.

It should be appreciated that the cooling mandrels 36 are interchangeable and detachably removable from housing 14 in order to permit the shell reforming system 10 to accommodate shells having different gauges. This facilitates and permits the shell reforming system 10 to accommodate shotshells, such as shotshell 40 in FIG. 1, having gauges of 410, 32, 28, 24, 20, 16, 12, 10 or 8 gauge or any other suitable size depending on the application.

Thus, it should be appreciated that controller 18 permits a user to selectively change the temperature of heat mandrel 24 to temperatures ranging between 0° and 900° F., which is the maximum heat capacity of thermocouple 26, as may be desired to reform the shotshell 40 to a desired shape, such as an elongated cylindrical shape which will permit the shotshell 40 to easily receive gun powder, wad, shot and the like at a later refilling station (not shown).

As best illustrated in FIG. 1, the shell reforming system 10 comprises an on-off toggle switch 42 for selectively coupling the shell reforming system 10 to a suitable AC power source (not shown) and also for energizing controller 18 when it is desired to reform one or more shotshells 40. In this regard, notice that the controller 18 comprises a plurality of digital displays 46 and 48 which display an actual temperature of heat mandrel 24 and a desired or predetermined temperature, respectively. The controller 18 comprises a plurality of switches 50 for selectively increasing or decreasing the temperature. The controller 18 also comprises a set switch 52 for locking or setting the heat mandrel 24 to a desired or predetermined temperature. This, in turn, facilitates setting and maintaining the temperature of heat mandrel 24 to a desired temperature so that as multiple shotshells 40 are reformed, the temperature of heat mandrel 24 remains substantially constant.

In the embodiment being described, it has been found that setting the controller 18 at a temperature of about 200° F. to 210° F. has been suitable for reforming ordinary shotshells 40 when the shells are situated on heat mandrel 24 for less than 10 seconds, for example. This temperature control feature further facilitates ensuring consistent reformation and provides the advantage of being able to reform the shotshells 40 consistently.

A locator switch 54 permits the operator to selectively change the magnitude of the temperature selected by multiples of 1, 10, 100 or even 1,000, up to the maximum heat capability of thermocouple 26 of 900° F. in the embodiment being described.

The shell reforming system 10 may also comprise a fan 41 which is coupled to a switch 53 situated on panel 16 as shown. The fan 41 facilitates maintaining the internal temperature of the shell reforming system 10 to a desired temperature, such as room temperature.

Figure 3:
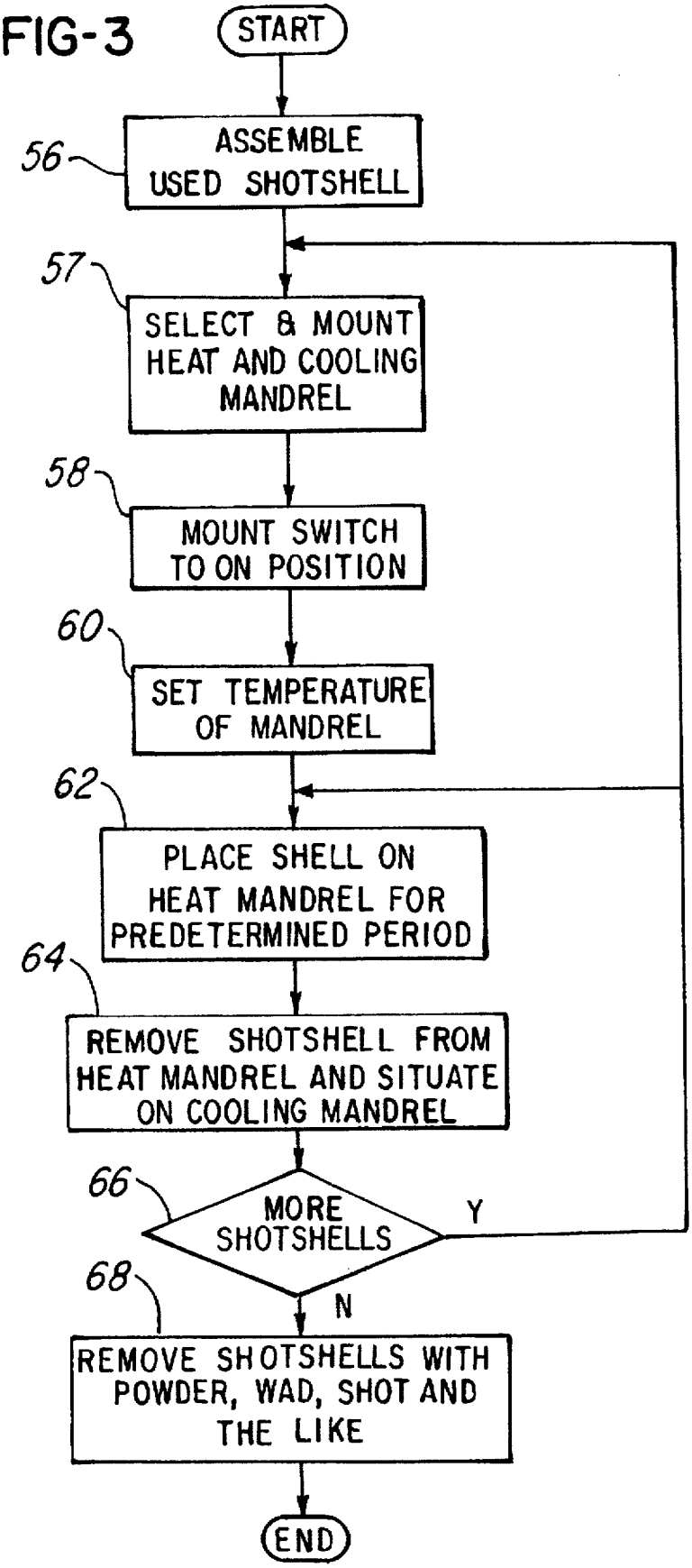
FIG. 3 is a general schematic of a method for reconditioning or reshaping shotshells utilizing features of the present invention.

A method for reloading shotshells will now be described relative to FIG. 3, where the method begins by assembling a plurality of used shotshells 40 (block 56). At this point, the shotshells 40 may be cleaned, for example. At block 57, a user selects and mounts heat and cooling mandrels 24 and 36, depending on the gauge of shotshells 40 to be reformed.

The switch 44 on the shell reforming system 10 is actuated to an ON position (block 58). At block 60, one or more of the switches 50, 52 and 54 may be actuated to set the shell reforming system 10 to a desired temperature, such as 210° F.

At block 62, the shotshells 40 are situated on heat mandrel 24 for a period of approximately 10 seconds in the embodiment being described. At block 64, the shotshell 40 is removed from heat mandrel 24 and situated on a cooling mandrel 36 for cooling the shotshell 40 for at least ten seconds so that it adopts the desired cylindrical shape mentioned earlier herein.

At decision block 66, it is determined whether more shotshells 40 have to be reformed. If they do, then the routine loops back to either block 57 or block 62 as shown, otherwise the reforming method is complete.

Thereafter, the reformed shotshells may be refilled with appropriate gun powder, wad, shot and the like and then crimped closed at one or more subsequent reloading stations (block 68). At this point the refilling routine is complete and the refilled shotshells 40 may be used as desired.

Advantageously, this system and method provide means for reforming shotshells 40 to a desired shape, such as a generally cylindrical and elongated shape, in order to facilitate reloading the shells at a subsequent reload station. The system and method provide means for accurately controlling the temperature delivered to the shotshells 40 such that they can be reformed to a consistent shape and over consistent periods of time. For example, the system and method of the present invention permit controlling the temperature such that the reforming can take shorter periods of time when the temperature is set at a higher temperature or longer periods of time if it is desired to heat the shotshell 40 at lower temperatures. Thus, while the embodiment has been described as operating at temperatures of about 210°, it should be appreciated that it can easily operate at other temperatures as well.

Advantageously, this system and method further provides means for accommodating shells of various gauges and accurately reforming them to a desired diameter.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A shell reforming system comprising:

a mandrel for receiving a shell, and a heater associated with said mandrel for heating said mandrel to a preselected temperature, said heater comprising a controller for controlling the heat delivered to said mandrel, such that when said shell is situated over said mandrel, said shell becomes deformed to a desired shape;

wherein said system further comprises at least one cooling mandrel for cooling said shell to achieve said desired shape.

2. The shell reforming system as recited in claim 1 wherein said mandrel comprises a parabolic shape for receiving a plurality of shell gauges.

3. The shell reforming system as recited in claim 2 wherein said plurality of shell gauges comprising a range from about 410 gauge to about 8 gauge.

4. The shell reforming system as recited in claim 1 wherein said heater is automatically controlled.

5. The shell reforming system as recited in claim 1 further comprising an alarm for alerting a user when said mandrel has achieved approximately said preselected temperature.

6. The shell reforming system as recited in claim 1 wherein said mandrel comprises a surface material which facilitates increasing the slide coefficient of said shell on said mandrel.

7. The shell reforming system as recited in claim 1 wherein said controller further comprises a lock for locking said heat delivered to said shell to a maximum heat.

8. The shell reforming system as recited in claim 7 wherein said maximum heat is less than 250 degrees Fahrenheit.

9. The shell reforming system as recited in claim 1 wherein said controller causes said heater to deliver a controlled heat of ranging between 0–250 degrees Fahrenheit.

10. A shell reforming system comprising:

a mandrel for receiving a shell, and a heater associated with said mandrel for heating said mandrel to a preselected temperature, said heater comprising a controller for controlling the heat delivered to said mandrel, such that when said shell is situated over said mandrel, said shell becomes deformed to a desired shape;

wherein said system further comprises a plurality of cooling mandrels for cooling said shell to achieve said desired shape.

11. The shell reforming system as recited in claim 10 wherein said plurality of cooling mandrels is interchangeable.

12. A method for reforming a shell comprising the steps of:

heating a heat mandrel to a controlled temperature;

situating the shell on said heat mandrel to reform said shell;

removing said shell; and situating said shell on at least one cooling mandrel in order to cool said shell to achieve said desired shape.

13. The method as recited in claim 12 wherein said method further comprises the step of:

setting said controlled temperature using a controller.

14. The method as recited in claim 12 wherein said heating step further comprises the step of:

heating said heat mandrel which comprises a parabolic shape for receiving a plurality of shell gauges.

15. The method as recited in claim 14 wherein said plurality of shell gauges comprising a range from about 410 gauge to about 8 gauge.

16. The method as recited in claim 12 wherein said heating step further comprises the step of:

heating said shell with a heat mandrel which is automatically controlled.

17. The method as recited in claim 12 further comprising the step of:

alerting a user when said mandrel has achieved approximately said preselected temperature.

18. The method as recited in claim 12 wherein said heat mandrel comprises a surface material which facilitates increasing the slide coefficient of said shell on said heat mandrel.

19. The method as recited in claim 12 wherein said method further comprises the step of:

limiting the heat delivered to said shell to a maximum heat.

20. The method as recited in claim 19 wherein said maximum heat is less than 250 degrees Fahrenheit.

21. The method as recited in claim 12 wherein said heating step further comprises the step of:

heating said heat mandrel to said controlled temperature ranging between 0–250 degrees Fahrenheit.

22. A method for reforming a shell comprising the steps of:

heating a heat mandrel to a controlled temperature;

situating the shell on said heat mandrel to reform said shell;

removing said shell; and selecting one of a plurality of cooling mandrels to cool said shell.

23. The method as recited in claim 22 wherein said plurality of cooling mandrels are interchangeable.

24. A shotshell reforming device comprising:

a base;

a heat mandrel secured to said base;

a heater coupled to said heat mandrel for heating said heat mandrel to a desired temperature;

a controller situated on said base and coupled to said heater for controlling heat delivered by said heater to said heat mandrel; and at least one cooling mandrel located on said base for cooling said shell to achieve said desired shape.

25. The shotshell forming device as recited in claim 24 wherein said heat mandrel comprises a parabolic shape for receiving a plurality of shell gauges.

26. The shotshell forming device as recited in claim 25 wherein said plurality of shell gauges comprises a range from about 410 gauge to about 8 gauge.

27. The shotshell forming device as recited in claim 24 further comprising an alarm for alerting a user when said mandrel has achieved approximately said preselected temperature.

28. The shotshell forming device as recited in claim 24 wherein said heat mandrel comprises a surface material which facilitates increasing the slide coefficient of said shell on said mandrel.

29. The shotshell forming device as recited in claim 28 wherein said surface material comprises a chrome plating.

30. The shotshell forming device as recited in claim 24 wherein said controller further comprises a lock for locking said heat delivered to said shell to a maximum heat.

31. The shotshell forming device as recited in claim 30 wherein said maximum heat is less than 250 degrees Fahrenheit.

32. The shotshell forming device as recited in claim 24 wherein said controller causes said heater to deliver a controlled heat of ranging between 0–250 degrees Fahrenheit.

33. A shotshell reforming device comprising:

a base;

a heat mandrel secured to said base;

a heater coupled to said heat mandrel for heating said heat mandrel to a desired temperature;

a controller situated on said base and coupled to said heater for controlling heat delivered by said heater to said heat mandrel; and a plurality of cooling mandrels situated on said base for cooling said shell to achieve said desired shape.

34. The shotshell forming device as recited in claim 33 wherein said plurality of cooling mandrels are interchangeable.

35. A method for reforming a used shotshell comprising the steps of:

heating a mandrel to a controlled temperature of less than 300 degree Fahrenheit;

situating said used shotshell on said heat mandrel for a predetermined period of time;

removing said used shotshell; and situating said used shotshell on a cooling mandrel.

36. The method as recited in claim 35 wherein said predetermined period of time is not more than ten seconds.

37. The method as recited in claim 35 wherein said method further comprises the step of:

locking said temperature to said controlled temperature to prevent the heat mandrel from being heated to a temperature in excess of said controlled temperature.

38. The method as recited in claim 35 wherein said method further comprises the step of:

selecting one of a plurality of cooling mandrels;

situating said one of said plurality of cooling mandrels on a base in order to receive said used shotshell.

39. The method as recited in claim 37 wherein said method further comprises the step of:

setting a digital switch on a controller to select said controlled temperature.

* * * * *